US012331501B2

(12) United States Patent
Wölfler et al.

(10) Patent No.: US 12,331,501 B2
(45) Date of Patent: Jun. 17, 2025

(54) SINK WITH FEED CHAIN OR SPINDLE DRIVE FOR AN INSERT PLATE WITH AN ADJUSTABLE HEIGHT

(71) Applicant: BSH Hausgeräte GmbH, Munich (DE)

(72) Inventors: Andreas Wölfler, Saalfelden (AT); Benjamin Reu, Prien am Chiemsee (DE); Ingo Abels, Siegsdorf (DE); Brigitte Meyer, Chieming (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/776,651

(22) PCT Filed: Nov. 11, 2020

(86) PCT No.: PCT/EP2020/081728
§ 371 (c)(1),
(2) Date: May 13, 2022

(87) PCT Pub. No.: WO2021/104870
PCT Pub. Date: Jun. 3, 2021

(65) Prior Publication Data

US 2024/0376698 A1 Nov. 14, 2024

(30) Foreign Application Priority Data

Nov. 29, 2019 (DE) ..... 102019218651.3

(51) Int. Cl.
*E03C 1/186* (2019.01)
*E03C 1/324* (2006.01)

(52) U.S. Cl.
CPC ..... *E03C 1/186* (2013.01); *E03C 1/324* (2013.01)

(58) Field of Classification Search
CPC ..... E03C 1/186; E03C 1/324
See application file for complete search history.

(56) References Cited

U.S. PATENT DOCUMENTS 1,370,088 A * 3/1921 Chervin ..... E03C 1/186 4/514
1,391,091 A * 9/1921 Arbuckle ..... E03C 1/324 248/295.11

(Continued)

FOREIGN PATENT DOCUMENTS

CN 103501076 A 1/2014
CN 104775486 A 7/2015

(Continued)

OTHER PUBLICATIONS

National Search Report DE 102019218651.3 dated Aug. 21, 2020.
International Search Report PCT/EP2020/081728 date Jan. 28, 2021.

*Primary Examiner* — Janie M Loeppke
(74) *Attorney, Agent, or Firm* — Michael E. Tschupp; Andre Pallapies; Brandon G. Braun

(57) ABSTRACT

A sink includes a basin including a base wall and lateral walls adjoining the base wall. The basin includes a receiving area which is delimited by the base wall and the lateral walls. An insert plate separate from the basin is inserted into the receiving area. A lifting device is configured to move the insert plate relative to the basin in a height direction and includes a lifting unit with a variable length. The lifting unit includes a lifting mechanism which is embodied as a feed chain or a spindle drive.

20 Claims, 5 Drawing Sheets

(56) References Cited

U.S. PATENT DOCUMENTS

| | | | | | |
|---|---|---|---|---|---|
| 1,864,184 | A * | 6/1932 | Cavert | E03C 1/324 | |
| | | | | 4/645 | |
| 2,817,094 | A * | 12/1957 | Lessley | E03C 1/324 | |
| | | | | 415/75 | |
| 3,882,553 | A | 5/1975 | Poiencot | | |
| 9,410,310 | B1 * | 8/2016 | Eckert | E03C 1/324 | |
| 11,939,753 | B2 * | 3/2024 | W?Ifler | E03C 1/186 | |
| 2005/0067747 | A1 | 3/2005 | Erickson | | |

FOREIGN PATENT DOCUMENTS

| | | | | |
|---|---|---|---|---|
| CN | 106579805 | A | 4/2017 | |
| CN | 108222146 | * | 6/2018 | E03C 1/186 |
| CN | 109235561 | A | 1/2019 | |
| CN | 109695275 | A | 4/2019 | |
| DE | 3621151 | A1 | 1/1988 | |
| DE | 10346411 | A1 | 5/2005 | |

* cited by examiner

SINK WITH FEED CHAIN OR SPINDLE DRIVE FOR AN INSERT PLATE WITH AN ADJUSTABLE HEIGHT

CROSS-REFERENCES TO RELATED APPLICATIONS

This application is the U.S. National Stage of International Application No. PCT/EP2020/081728, filed Nov. 11, 2020, which designated the United States and has been published as International Publication No. WO 2021/104870 A1 and which claims the priority of German Patent Application, Serial No. 10 2019 218 651.3, filed Nov. 29, 2019, pursuant to 35 U.S.C. 119 (a)-(d).

The contents of International Application No. PCT/EP2020/081728 and German Patent Application, Serial No. 10 2019 218 651.3 are incorporated herein by reference in their entireties as if fully set forth herein.

BACKGROUND OF THE INVENTION

One aspect of the invention relates to a sink with a basin. The basin has a base wall and lateral walls adjoining the base wall. The basin has a receiving area delimited by the walls. In addition, the sink has an insert plate which is separate from the basin and which is inserted into the receiving area.

Such sinks are known. Thus for example a sink is known from US 2005/0067747 A1 which has a basin. A stanchion formed integrally with the floor of the basin and extending upward is embodied on the floor of the basin. A plate can be attached to this stanchion. As a result a cutting board is formed, on which items such as food can be cut. A configuration such as this is disadvantageous, in that the integrated stanchion is always present and thus a basic configuration of the basin is complex in form, and is also embodied so as to circumferentially restrict the receiving area. In addition, the plate that can be placed on the stanchion is always arranged at just one height. It can only be put on or removed by a user.

In addition, a sink is known from DE 362 1151 A1. Different inserts are provided that are separate from the basin and can be inserted into the receiving area. The inserts can be plates or further basin-like containers. These can be placed at the top edge of the basin. The result of this is also that the usability of a sink is greatly restricted and the inserts have to be put on or removed by a user and can always only be positioned at an individual location.

BRIEF SUMMARY OF THE INVENTION

It is the object of the present invention to create a sink with a basin and a separate insert plate, in which the height of the insert plate can be varied precisely.

One aspect of the invention relates to a sink with a basin. The basin has a base wall and lateral walls adjoining the base wall. The basin additionally has a receiving area which is delimited by the base wall and the lateral walls. The receiving area is open at the top. The sink has an insert unit, in particular an insert plate, in particular a continuous and hole-free insert plate, which is separate from the basin. This can be inserted into the receiving area or is inserted therein. The sink additionally has a lifting device, with which the insert plate can be moved in the height direction of the sink relative to the basin. This is enabled by the lifting device of the sink forming the subject matter of this patent. Thus a sink is now provided in which the possibility is in principle created of arranging the insert unit at different heights. This is additionally also facilitated by a lifting device and need not be done manually by users themselves. In principle this means that thanks to the lifting device it is possible to continuously adjust the height of the insert plate. It is thus possible to move and adjust the insert plate to very many different heights. A travel speed of the insert plate in this case is preferably between 10-70 mm/sec., in particular preferably between 30-50 mm/sec. The maximal possible travel path of the insert plate is preferably between 100 and 300 mm, in particular preferably between 120 mm and 250 mm.

The lifting device has a lifting unit with a lifting mechanism, said lifting unit being variable in length in the height direction of the sink. This lifting mechanism is a feed chain or a spindle drive.

Thanks to such specific embodiments for a lifting unit a mechanically robust concept can be provided, with which the insert plate can be moved precisely in this height direction. The feed chain or the spindle drive also each represent a unit in which even a heavy insert plate can be moved continuously and therefore also smoothly up or down in the height direction. Even if objects are still positioned on this insert plate, a feed chain or a spindle drive can move a weight such as this without difficulty in this height direction. On the other hand, a feed chain or a spindle drive also represents a unit which is operational on a long-term basis in the environmental conditions of a sink. Even if corresponding temperature variations occur, as can be the case if hot water, or on the other hand cold water, is run into the basin of the sink, this has no effect on the operability of a feed chain or of a spindle drive. Thus low wear and tear is likewise ensured. Last but not least, a feed chain or a spindle drive is also a very space-saving concept for a lifting unit. In the case of the sink it is in particular advantageous in order that the receiving area not be undesirably restricted by such a lifting unit. This lifting mechanism of the lifting unit thus represents a subcomponent of the lifting unit.

The lifting unit preferably has a housing which peripherally surrounds the lifting mechanism and thus the feed chain or the spindle drive. This means that this lifting mechanism is completely surrounded by the housing in the direction of rotation about a longitudinal axis of the lifting unit oriented in the height direction. This is a very advantageous embodiment, since as a result the lifting device is on the one hand extensively protected against media in the basin of the sink. In addition, contact protection for the lifting mechanism is also formed by this housing. A user is thereby likewise prevented from coming into direct contact with the lifting mechanism.

This housing of the lifting unit is preferably formed from multiple, in particular rigid housing segments. These housing segments can be moved relative to one another in the height direction of the sink. This is a further very advantageous embodiment, since the length of the housing of the lifting unit is thus also variable in this height direction and thus can likewise move in line with the variation in length of the lifting mechanism. In any position of the lifting mechanism in this height direction, full protection is thus provided by the housing. To create as compact a lifting unit as possible, the latter preferably has at least 4, in particular at least 5 housing segments. In order to save weight and with a view to an inexpensive configuration it is advantageous if the housing segments are made of plastic.

These housing segments are in particular hollow cylinders.

In an advantageous embodiment it is provided that the housing segments form a telescopic housing of this lifting unit. The housing segments are each preferably provided with at least one circumferential molding, or notch, each of which forms an anti-twist device. Furthermore, a sealing element is further preferably in each case arranged between the individual housing segments, and is for example formed as an O-ring.

In an advantageous embodiment it is provided that the spindle drive has at least two spindles that are separate and coupled to one another. In particular, these spindles are guided into one another. Thanks to a concept such as this the individual spindles can be designed to be shorter. Thus a higher level of bending stiffness is also achieved compared to very long spindles. In addition, thanks to multiple separate spindles of this type that are connected to one another and can rotate relative to one another, the height of the lifting unit can be adjusted particularly precisely. A very continuous and smooth height adjustment is thereby enabled.

The spindles in this connection represent thin rods. Hence they require minimal space in a horizontal plane. As a result, the receiving area of the basin is not undesirably restricted. In order to achieve a low construction height of the lifting unit, the latter has at least three spindles coupled to one another. To enable a lightweight and inexpensive lifting unit, the spindles are preferably made of plastic.

It is preferably provided that an upper spindle of this spindle drive is connected by an upper end to a cover of the lifting device which is separate therefrom. In particular, this cover is a cover plate and in particular represents a flat disk. In an advantageous embodiment the insert plate is arranged on the cover. It can be arranged on the cover directly from above. The insert plate can however also be arranged indirectly on the cover. This means that a further component can be arranged between the cover and the insert plate. For example, this can be a plate receiving area separate from the cover. This plate receiving area can be a flat disk and thus a flat cylinder. In an advantageous embodiment at least one support wing can be arranged on this plate receiving area. The insert plate can be arranged directly on this support wing. The in particular at least two support wings, which are each preferably V-shaped, can be arranged on the plate receiving area so as to pivot about horizontal axes.

In an embodiment such as this, in which the spindle does not engage directly with the insert plate, wear and tear to the insert plate can be prevented. In addition, thanks to this at least one cover an improved mechanical coupling concept can be achieved. This is because the spindle can thus be designed as individually mechanically stable and nevertheless individually in respect of movability relative to the cover and to the height adjustment. The insert plate need not hence then be designed individually on its lower surface for this purpose.

In an advantageous embodiment it is provided that this upper spindle is connected to the cover by an infinite rotation unit. This means that the spindle is mechanically connected to the cover, but that when connected to the cover the spindle can rotate relative to the cover about an axis of rotation oriented in the height direction, without any adjustment to the distance between the spindle and the cover in the height direction being needed. When the lifting unit is raised in the height direction the upper spindle is arranged so that it can rotate relative to the cover infinitely about an axis of rotation oriented in the height direction. As a result, a direct mechanical coupling of the upper spindle to this cover is on the one hand achieved, and there is nevertheless no need for the cover to be likewise rotatably mounted in this respect. The cover can thus be arranged so as to be positionally stable with the insert plate. Nevertheless the rotary movement of the spindle is not restricted and an extremely precise height adjustment of the cover with the insert plate arranged thereon is enabled.

In an advantageous embodiment it is provided that the infinite rotation unit is for example a ball bearing. As a result, a stable mechanical coupling can take place on the one hand, and on the other hand a particularly smooth-running and nevertheless resilient rotation of the upper spindle relative to the cover coupled thereto can be performed.

It is preferably provided that the lifting device has a motor to drive the lifting mechanism. In an advantageous embodiment this motor is arranged in a receiving housing of the lifting device. In an advantageous embodiment this receiving housing is arranged completely underneath the base wall of the basin. As a result, the receiving area of the basin is not restricted by this receiving housing. On the other hand, easy access to the receiving housing is also then enabled by this arrangement of the receiving housing. Last but not least, in an advantageous embodiment the motor of the lifting device is as a result arranged completely outside the receiving area of the basin. This is advantageous in order to be able optimally to prevent media in the receiving area from affecting the motor. On the other hand, undesired temperature influences on the motor, in particular temperature variations caused by hot or cold media in the receiving area, can as a result be prevented. The receiving housing in this case preferably has a height, or an extension underneath the base wall in a direction pointing away therefrom, of less than 150 mm, in particular of less than 100 mm. Thanks to a flat embodiment such as this there is still enough room left under the sink for garbage containers or the like.

It is preferably provided that the motor is connected to a lower spindle of the spindle drive. This lower spindle can be moved by the motor in a rotation about an axis of rotation oriented in the height direction.

In an advantageous embodiment it is provided that the base wall has an opening or a through-hole. In particular, this opening is embodied centrally in the base wall. The lifting unit extends through this opening, so that it is arranged on both sides of this opening. In particular, both the lifting mechanism of the lifting unit and also an advantageously present housing of the lifting unit extend through this opening and are arranged on both sides of this opening.

In an advantageous embodiment it is provided that the lifting device has only a single lifting unit with a variable length. As a result, a concept that has a reduced number of components and is space-saving can be enabled. In particular, with the preferably present support wings, which are arranged on an upper lifting segment of the lifting unit and on which the insert plate then rests, this single lifting unit with a variable length is sufficient. Thanks to these support wings a support structure that is larger in the horizontal plane can be created, which receives the insert plate securely and protects it against undesired inclined positions, even if only a single lifting unit is present.

In an advantageous embodiment it is provided that the lifting device has at least one separate attenuation unit. By means of this attenuation unit the lifting device is acoustically decoupled from the base wall. This is also a very advantageous embodiment. This is because noises that arise when the lifting unit is raised or lowered, in particular noises from the motor and/or noises from the lifting mechanism, cannot as a result be transferred to the basin, or only to a significantly reduced extent.

It can be provided that the attenuation unit is a rubber attenuator or an acoustic foam. These specific attenuation units are on the one hand easy to fit as regards installation. On the other hand, they also provide a high level of attenuation behavior even in the case of relatively small configurations.

It is preferably provided that the attenuation unit rests directly on a lower surface or on an outer surface of the base wall of the basin. In particular, this attenuation unit is connected to a receiving housing of the lifting device which is arranged under the base wall. Thus a particularly efficient acoustic decoupling can take place.

In an advantageous embodiment it is provided that an upper surface of the insert plate has a surface area which is at least 80 percent, in particular at least 90 percent, in particular at least 95 percent of the surface area of the receiving area in a horizontal plane. The surface area of the upper surface of the insert plate is however less than 99 percent of this surface area of the receiving area. Thanks to dimensioning such as this the insert plate is embodied as virtually covering the full area in respect of the clear width of the receiving area between the lateral walls and thus fills this receiving area almost completely when viewed in the horizontal plane. On the other hand, a small gap, in particular between 3 mm and 15 mm, in particular between 3 mm and 10 mm, is circumferentially enabled, such that on the one hand the relative movement of the insert plate can take place unimpeded in the case of an adjustment in position or a change in position. In particular, as a result a direct contact and where appropriate grazing of a lateral edge of the insert plate on the inner surfaces of the lateral walls can be prevented. Thus on the one hand damage to the lateral walls can be prevented, and on the other hand damage to the insert plate as well as to the lifting device can be prevented. Last but not least, it is also advantageously achieved by this configuration that thanks to this gap between the edge of the insert plate and the inner surfaces of the lateral walls, liquid that is present on the upper surface of the insert plate can drain into the receiving area without difficulty.

The basin preferably has an outflow, in particular on the base wall. As a result, a medium that is arranged in the basin and that collects there can drain out via the outflow without difficulty.

In particular, the basin is integrally embodied with the base wall and the lateral walls. In particular, the basin is made of metal.

The base wall can be level or slightly inclined or slightly arched. In particular, it is provided that the point in the base wall at which an outlet for a drain of the sink is embodied is moved as far down as possible in respect of height.

It can be provided that the upper surface of the insert plate is embodied as completely level. It can however also be slightly arched. It is also possible for the upper surface of the insert plate to be structured, at least in part. As a result, a certain roughness can be created. Unintentional slippage of objects placed thereon can thereby be better prevented. For example, this is advantageous if a change is made to the position of the insert plate and objects are still arranged on the upper surface of the insert plate. Likewise it is possible for the upper surface to have specific positioning regions. These can be depressions. For example, depressions such as these can however be embodied as relatively minor. This is advantageous in order for example to be able to securely position vessels such as a glass or the like. In particular, this is advantageous if a change in position is a tilt and/or a rotation. Unintentional slippage of such vessels is then prevented. In addition, the presence of such predefined positioning regions means that for example if vessels are placed on the upper surface of the insert plate and for example are to be filled via the faucet, the water running out of the faucet runs accurately into the vessels in the event of a rotary movement and does not run past the circumference of the vessels and hit the insert plate.

The lifting device can have a lifting unit and a motor. With the motor the lifting unit can be moved at least in a height direction.

The feed chain consists of specially shaped highly precise and mechanical chain links. The chain links engage over one another continuously in a form-fit manner. The special feature of the feed chain, in contrast to a "normal" chain, is that it works in both directions. It can pull and "push".

Located in the drive housing of the feed chain is a pinion, which engages in the intermediate links of the chain and moves the chain link by link—both forward and backward. The chain itself has two loose ends. The load to be moved is fastened to one end. The other end can be guided freely and is generally rolled up in a box. This saves installation space and is the main advantage of the feed chain.

Thrust power is exerted on the chain links via the drive element, generally an electric motor. The shoulders of the individual chain links are then pressed against one another and form a rigid unit. And thus they can lift or push the load.

The terms "upper", "lower", "front", "rear", "horizontal", "vertical", "depth direction", "width direction", "height direction" are used to specify the positions and orientations existing when the sink is used correctly and arranged correctly.

Further features of the invention emerge from the claims, the figures and the description of the figures. The features and combinations of features referred to above in the description, along with the features and combinations of features referred to below in the description of the figures and/or shown in isolation in the figures can be used not only in the respectively specified combination, but also in other combinations or in isolation, without departing from the scope of the invention. Thus embodiments of the invention are also to be regarded as included and disclosed that are not explicitly shown and explained in the figures, but which can arise and be created from the embodiments explained thanks to separate combinations of features. Embodiments and combinations of features are also to be regarded as disclosed that do not have all features of an originally formulated independent claim.

BRIEF DESCRIPTION OF THE DRAWINGS

Exemplary embodiments of the invention are explained in greater detail below using schematic drawings, in which.

DETAILED DESCRIPTION OF EXEMPLARY EMBODIMENTS OF THE PRESENT INVENTION

Figure 1:
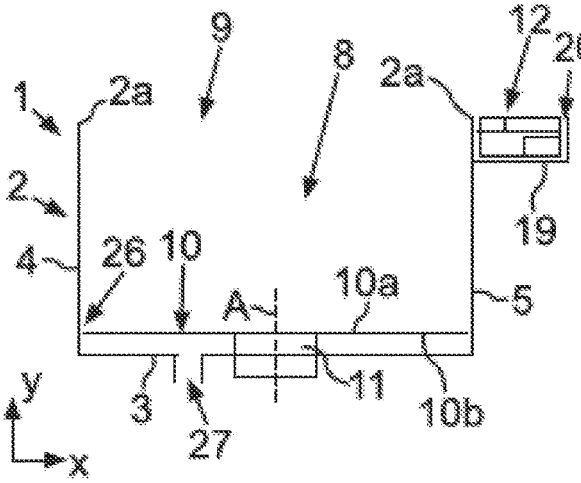
FIG. 1 shows a schematic sectional view through an exemplary embodiment of an inventive sink with an insert plate in a first position.

In the figures identical or functionally identical elements are provided with the same reference characters.

Figure 3:
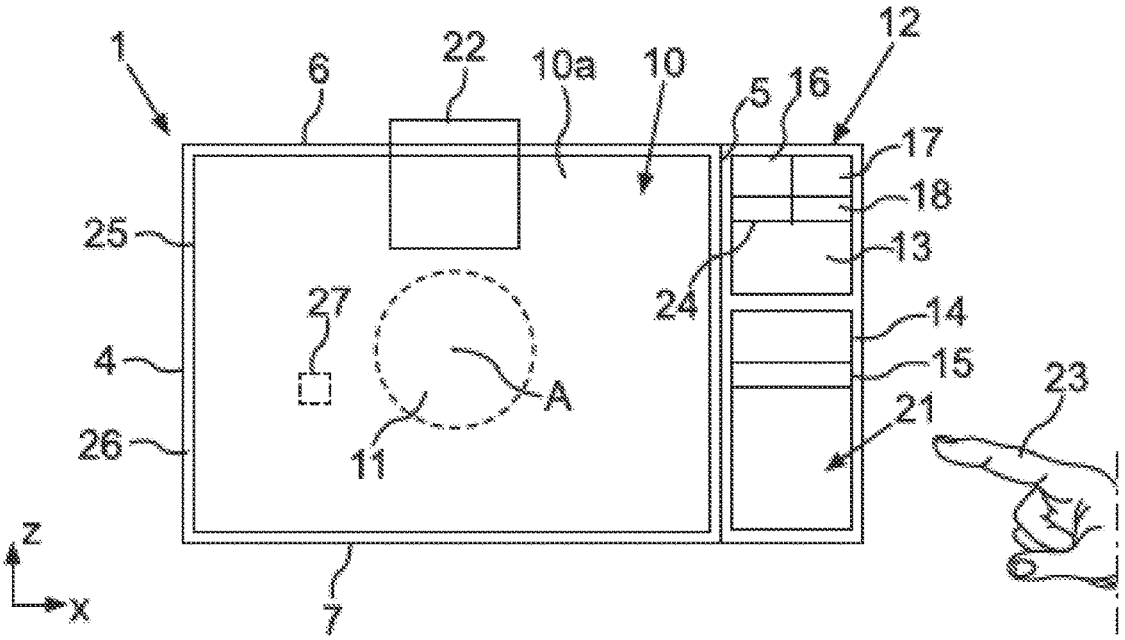
FIG. 3 shows a plan view of an exemplary embodiment of a sink.

FIG. 1 shows a schematic vertical sectional view (x-y plane with height direction y and width direction x) of a sink 1. The sink 1 has a basin 2. The basin 2 has a base wall 3 and lateral walls 4, 5, 6 and 7 (FIG. 3) adjoining the base wall 3 and extending upward (FIG. 3). The basin 2 is in particular embodied in one piece. It is preferably made of metal. The basin 2 has a receiving area 8. The receiving area 8 is delimited by the aforementioned walls 3 to 7. Thus the basin 2 has an upper loading opening 9. The sink 1 additionally has an insert unit. The insert unit is in particular an insert plate 10. The insert plate 10 is in particular embodied in one piece. The insert plate 10 is a component of the sink 1 separate from the basin 2. The sink 1 further has a lifting device 11. The insert plate 10 is arranged on the lifting device 11. In particular, it is arranged on the lifting device 11 so as to be non-destructibly detachable. Thanks to the lifting device 11 the insert plate 10 can be moved relative to the basin 2. In this connection a movement can take place in the height direction (y-direction) of the sink 1. Additionally or instead, a rotation about a vertical axis A of the lifting device 11 can take place. Additionally or instead, a tilting of the insert plate 10 can take place. This means that the plane of the insert plate 10 can be set at an angle to a horizontal plane. It can thus be positioned as inclined or angled. In FIG. 1 the insert plate 10 is shown in an exemplary position in the receiving area 8. In particular, this is a position moved downward. The insert plate 10 is in this respect arranged immediately adjacent to the base wall 3.

The sink 1 preferably has an interaction unit 12. The interaction unit 12 can have a display unit 13 (FIG. 3). The interaction unit 12 can have a control device 14. The control device 14 can have one or more control elements. The control elements can be pushbuttons or switches or tilt elements or rotary buttons. The control device 14 can however also additionally or instead have a touch-sensitive control panel 15. In an advantageous embodiment it can be provided that the interaction unit 12 has at least one optical detection unit 16. The optical detection unit 16 can be a camera, for example. The camera can be sensitive in the spectral range that is visible for humans. The interaction unit 12 can however also additionally or instead have an acoustic unit 17. This acoustic unit 17 can be embodied to receive and/or emit voice signals. In addition, the interaction unit 12 can have an identification unit 18. The identification unit 18 is embodied to recognize or identify a user of the sink 1. The identification unit 18 can for example also be formed by the optical detection unit 16. Additionally or instead, the identification unit 18 can however also for example have the acoustic unit 17. As a result, the user can be identified, for example by evaluation of a voice signal of a user. Additionally or instead, the identification unit 18 can be embodied as a unit for detecting and evaluating a biometric feature of a user. For example, this can be a fingerprint sensor or a sensor for the recognition of an iris pattern.

Figure 2:
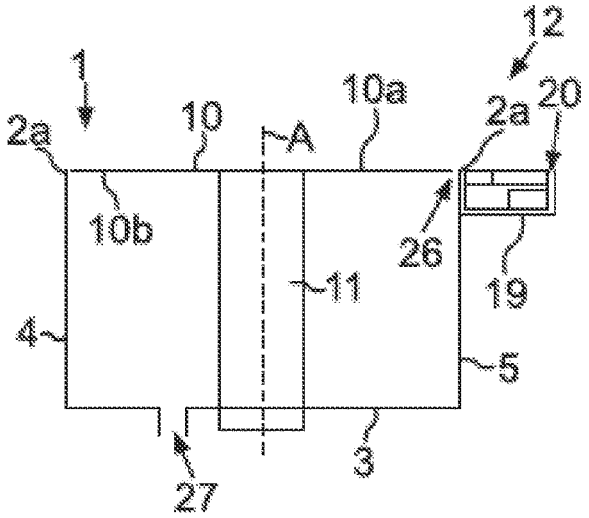
FIG. 2 shows the view of the sink in accordance with FIG. 2 with the insert plate in a second position different from FIG. 1.

As can be seen in FIGS. 1 to 3, the interaction unit 12 can be embodied as lateral and immediately adjacent to the basin 2. For example, a receiving housing 19 open at the top can be provided here. The receiving housing 19 can be embodied as separate from the basin 2. It can however also be formed so as to be non-destructibly non-detachable from the basin 2. In particular, the receiving housing 19 can also be integrally formed with the basin 2. The lateral wall, in the example here the lateral wall 5, directly adjoining the receiving housing 19 also forms a delimiting wall for the receiving volume 20 of the receiving housing 19.

Thus the receiving volume 20 is separated from the receiving area 8 of the basin. In FIG. 2 the view shown is in accordance with FIG. 1, but the insert plate 10 is shown in a position different from that in FIG. 1. In FIG. 2 the insert plate 10 is oriented horizontally, but moved upward. In particular, this position represents the maximum possible height. In particular, in this position an upper surface 10*a* of the insert plate 10 is flush with an upper edge 2*a* of the basin 2. In particular, in this position the insert plate 10 forms a cover or lid for the receiving area 8. This upper edge 2*a* can also for example be an upper surface of an installation frame or of a decorative frame, which is part of the sink 1. With the installation frame the sink 1, in particular the basin 2, can be installed in a recess of a worktop. With a decorative frame the basin 2 can be covered from above. A gap between the basin 2 and a delimiting wall in the worktop, which delimits the recess, can thus be covered from above. A decorative frame such as this in particular represents an upper visible component of the arrangement.

In particular, the sink 1 also has a control unit 21 (FIG. 3). Thanks to the control unit 21 the lifting device 11 can be operated. In particular, thanks to the control unit 21 the interaction unit 12 can also be operated.

The sink 1 can, as can be seen in the simplified plan view in FIG. 3, preferably also have a faucet 22. The faucet 22 represents a functional unit of the sink 1. Likewise the interaction unit 12, in particular the control device 14, can be regarded as a functional unit of the sink 1. A further functional unit of the sink 1 can be the insert plate 10. A further functional unit of the sink 1 can be the lifting device 11.

The lifting device 11 preferably has a lifting unit and a motor. As a result, its length and height can be changed in the direction of the vertical axis A. In addition, it can additionally or instead be rotated about the vertical axis A. As a result, a rotary movement about this vertical axis A is also enabled as a position or change in position of the insert plate 10. Last but not least, the lifting device 11 can also be adjusted such that the insert plate 10 can be adjusted so as to be angled or inclined compared to a horizontal plane.

With the interaction unit 12 an operating state of the sink 1 can be identified and/or a change in operating state of the sink 1 can be identified and/or a control action of a user operating the sink 1, in particular at least one functional unit of the sink 1, can be identified. As a function of the identification by the interaction unit 12 the lifting device 11 can be operated for the automatic change in position of the insert plate 10. FIG. 3 additionally shows a schematic view of a user's finger 23. The interaction unit 12 is preferably embodied to detect a gesture of the user, in particular of the finger 23. In particular, the gesture is a non-contact gesture. Additionally or instead however, the control device 14 can be operated directly with the finger 23. It is provided that an operating state and/or a change in operating state can be detected by the camera 16 and/or the acoustic unit 17 and/or the control device 14. An operating state can for example be a setting of the control device 14 and/or a change in the operating state can be a change in the setting of the control device 14.

A change in position of the insert plate 10 can be a function of the type and/or level and/or duration of an operating state of at least one functional unit of the sink 1 and/or a change in position can be a function of the type and/or level and/or duration of a change in operating state of at least one such functional unit of the sink 1.

The interaction unit 12 has a normal mode. In this, the actual operation of the sink 1 is also detected. In addition, the interaction unit 12 has a defining mode different from the normal mode. This can for example be set by a user. In this defining mode it is possible for at least one user to define or stipulate at least one reference position of the insert plate 10. In particular, such a reference position can in this defining mode be linked to a specific operating state of at least one functional unit of the sink 1 and/or to a defined change in operating state of at least one functional unit of the sink 1. At least one such reference position can be saved as a user profile in a memory unit 24 of the interaction unit 12.

In an advantageous embodiment it is provided that the surface area shown in FIG. 3 (depth direction z and width direction x) of the upper surface 10*a* is at least 80 percent, in particular at least 90 percent, in particular at least 95 percent of the surface area of the receiving area 8, viewed in a horizontal plane (in FIG. 3 the plane of the figure). In particular, this surface area of the upper surface 10*a* is however less than 99 percent of this surface area of the receiving area 8 in the cited horizontal plane. The result is that a circumferential edge 25 of the insert plate 10 is spaced apart from the lateral walls 4, 5, 6 and 7. In particular, as a result a circumferential gap 26 is formed between the insert plate 10 and the lateral walls 4 to 7. The gap 26 can be between 3 mm and 15 mm. Preferably this gap 26 so small, at least in the horizontal position of the insert plate 10, that objects such as an item of flatware or the like cannot slip through. In this horizontal position of the insert plate 10 it is also possible to prevent a finger 23 from being trapped.

As is further shown in FIGS. 1 to 3, the sink 1 has an outflow opening 27, for example a drain. This is in particular embodied in the base wall 3. Thanks to this outflow opening 27, media from the receiving area 8 can drain out of the basin 2.

Figure 4:
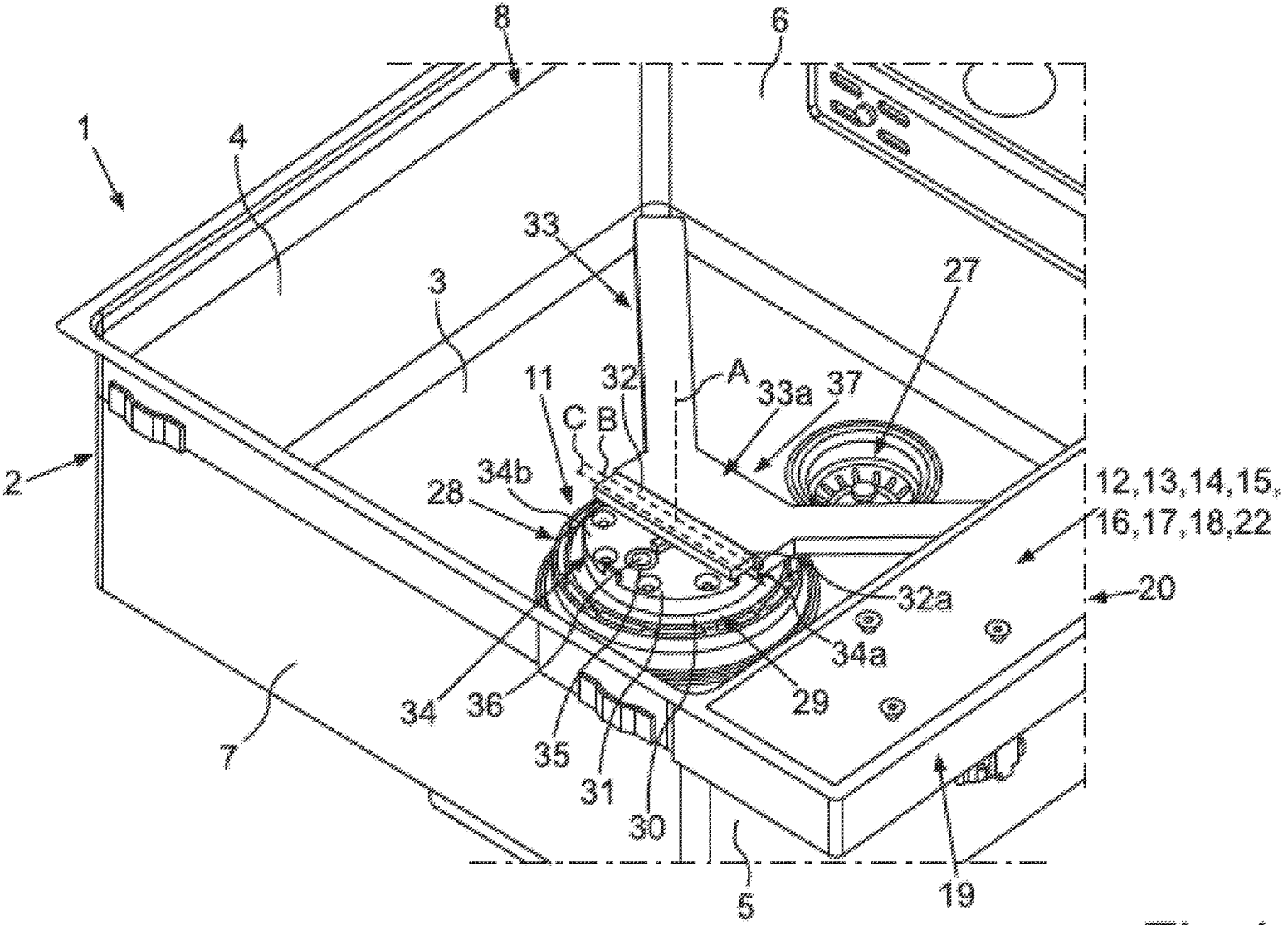
FIG. 4 shows a perspective partial view of an exemplary embodiment of a sink with an exemplary embodiment of a lifting device.

FIG. 4 shows in a perspective view an exemplary embodiment of a sink 1. The lifting device 11 is shown. The lifting device 11 has a lifting unit 28. This is in particular fastened centrally to the base wall 3. The lifting unit 28 can be moved in the direction of the axis A. The travel speed is in this case preferably between 10 and 70 mm/sec., in particular preferably between 30 and 50 mm/sec. The maximum possible lifting height of the lifting unit 28 is preferably between 100 and 300 mm, particularly preferably between 120 and 250 mm. The lifting unit 28 has in this connection multiple lifting segments. In FIG. 4 the lifting unit 28 is shown in a fully retracted state. This means that it is drawn down as far as possible into the receiving area 8. This lifting unit 28 preferably has an upper lifting segment. The upper lifting segment is in particular formed by an upper housing segment 29 of a housing 40 of the lifting unit 28. A plate receiving area 31 is arranged in an upper region 30 of this upper lifting segment. The plate receiving area 31 is here a disk in the form of a flat cylinder. This plate receiving area 31 has a central web 32. Arranged on this central web 32 is a first support wing 33. In particular, the support wing 33 is mounted on the central web 32 so that it can pivot about a horizontal axis B. The integral support wing 33 rests on the plate receiving area 31 from above. An upper surface 34 of this plate receiving area 31 has upper surface regions 34*a* and 34*b*. These are moved downward compared to the central web 32. The support wing 33 rests on this upper surface region 34*a*. For greater clarity, a second support wing that is separate from the first support wing 33, but in particular is the same size and same shape, is arranged, but is not shown. This is mounted in the central web 32 so as to pivot about a further horizontal axis C. The horizontal axes B and C are oriented in parallel to one another. The second support wing rests on the second upper surface region 34*b* from above. In the horizontal basic position an upper surface 33*a* of the support wing 33 is flush with an upper surface 32*a* of the central web 32. Accordingly, this is formed with an upper surface of the second support wing.

Thanks to the central web 32 the support wing 33 and the second support wing (not shown) are arranged spaced apart from one another. They can be swiveled independently of one another about their axes B and C. Thus individual tilt positions of a support wing 33 relative to the horizontal plane can also be set. In particular, to this end the plate receiving area 31 has a leadthrough 35. Thanks to this leadthrough an actuation element can extend from below through the plate receiving area 31 and thus in this case contact and lift the second support wing from below, such that it is swiveled about its horizontal axis C. Accordingly, on the side opposite the leadthrough 35 a further leadthrough is embodied in the plate receiving area 31, which is underneath the first support wing 33. This too can then be raised accordingly, as has been explained. It is preferably provided that the leadthrough 35 is covered from above by a flexible cover 36. The flexible cover 36 enables the actuation element to project through the leadthrough 35 and to be positioned standing further up compared to the upper surface region 34*b* and because of the flexible deformation of the flexible cover 36 a corresponding overhang of the actuation element can be brought about. As a result, the corresponding second support wing can then also be raised.

The plate receiving area 31 with the cover 36 is embodied as a 2 k injection-molded component.

Figure 5:
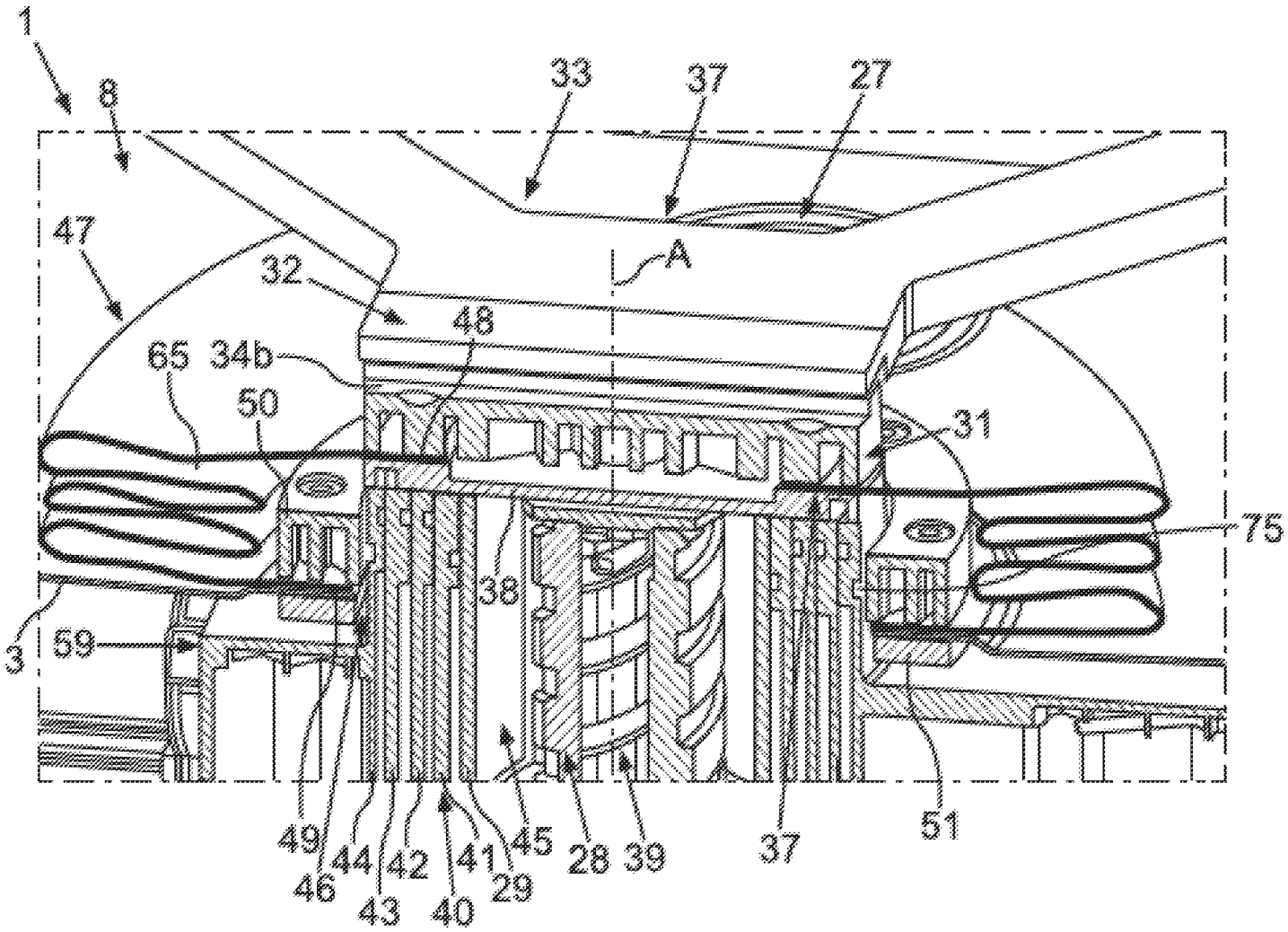
FIG. 5 shows a perspective sectional view of a subregion of the arrangement in FIG. 4 with a sealing sleeve around a lifting unit of the lifting device.

FIG. 5 shows a perspective sectional view of a subregion of the arrangement in FIG. 4.

It can be seen that the plate receiving area 31 embodied as a flat cylinder rests from above on an upper surface 37 of the upper lifting segment of the lifting unit 28. This upper surface 37 is in particular an upper surface of an upper cover plate 38.

The lifting unit 28 has a lifting mechanism 39. The lifting mechanism 39 can be a spindle drive. However, it can also be a feed chain, for example. The lifting unit 28 additionally has a housing 40. The housing 40 surrounds this lifting mechanism 39 circumferentially. The housing 40 is in particular a telescopic housing. This means that it has multiple housing segments. In the exemplary embodiment these lifting segments are embodied as hollow cylinders. Embodied in the exemplary embodiment is an upper housing segment 29 in an extended state, following below this a second housing segment 41, again following below this a further housing segment 42, once again following further below this a housing segment 43, and then a lower housing segment 44. The housing segments 29, 41, 42, 43 and 44 are preferably made of plastic. They each have circumferential contours which form a reciprocal protection against twisting. FIG. 5 shows the fully retracted position of the lifting unit 28. The lifting unit 28 has thus traveled fully downward. In this state the housing 40 is fully telescoped together and is in a minimized height position. The housing segments 29 and 41 to 44 are thus fully telescoped together, as is shown in FIG. 5. If the lifting unit 28 is moved out of this downwardly traveled state, in which the insert plate 10 is then also arranged in the lowered position, and is thus moved upward, the housing segments 29 and 41 to 44 are pulled apart. The lifting mechanism 39 is arranged in an interior 45 of this housing 40. The lifting unit 28 extends through a leadthrough or through-hole 46 in the base wall 3. The lifting unit 28 is thus arranged on both sides of this base wall 3.

In addition, the lifting device 11 has a sealing sleeve 47. The sealing sleeve 47 is a separate component from the housing 40. The sealing sleeve 47 circumferentially surrounds the subregion, which extends in the receiving area 8, of the lifting unit 28. The sealing sleeve 47 is embodied as flexible. It can be embodied in one piece. It can for example be embodied as a bellows. However, other specifications are also enabled, in terms of material and geometry.

In FIG. 5 the sealing sleeve 47 is embodied as a bellows. It is shown in FIG. 5 in the fully retracted or folded state. The sealing sleeve 47 has an upper edge 48. In the exemplary embodiment shown the upper edge 48 is clamped between the plate receiving area 31 and the cover 38. In particular, this upper edge 48 is also arranged with a sealing function between the plate receiving area 31 and the cover 38. The cover 38 can also be referred to as a lift plate.

In addition, this sealing sleeve 47 has a lower end 49. This lower end 49 rests directly on the inner surface of the base wall 3. In addition, it is provided that the sink 1 has an adapter 50. This adapter 50 is preferably a separate component. The adapter 50 is preferably designed as an adapter ring embodied as circumferential and uninterrupted. The adapter 50 is placed from above on this lower edge 49 of the sealing sleeve 47. As can be seen, the lower edge 49 is clamped between this adapter 50 and the base wall 3. In particular, a clamping with a sealing action is also embodied here.

In particular, the adapter 50 is fastened to the base wall 3 so as to be non-destructibly detachable, in particular screwed with screw connections. To this end a counter bearing 51 can be arranged under the base wall 3 for example. This counter bearing 51 can be a bearing ring. At the same time the counter bearing can be embodied as an acoustic attenuation unit.

Figure 6:
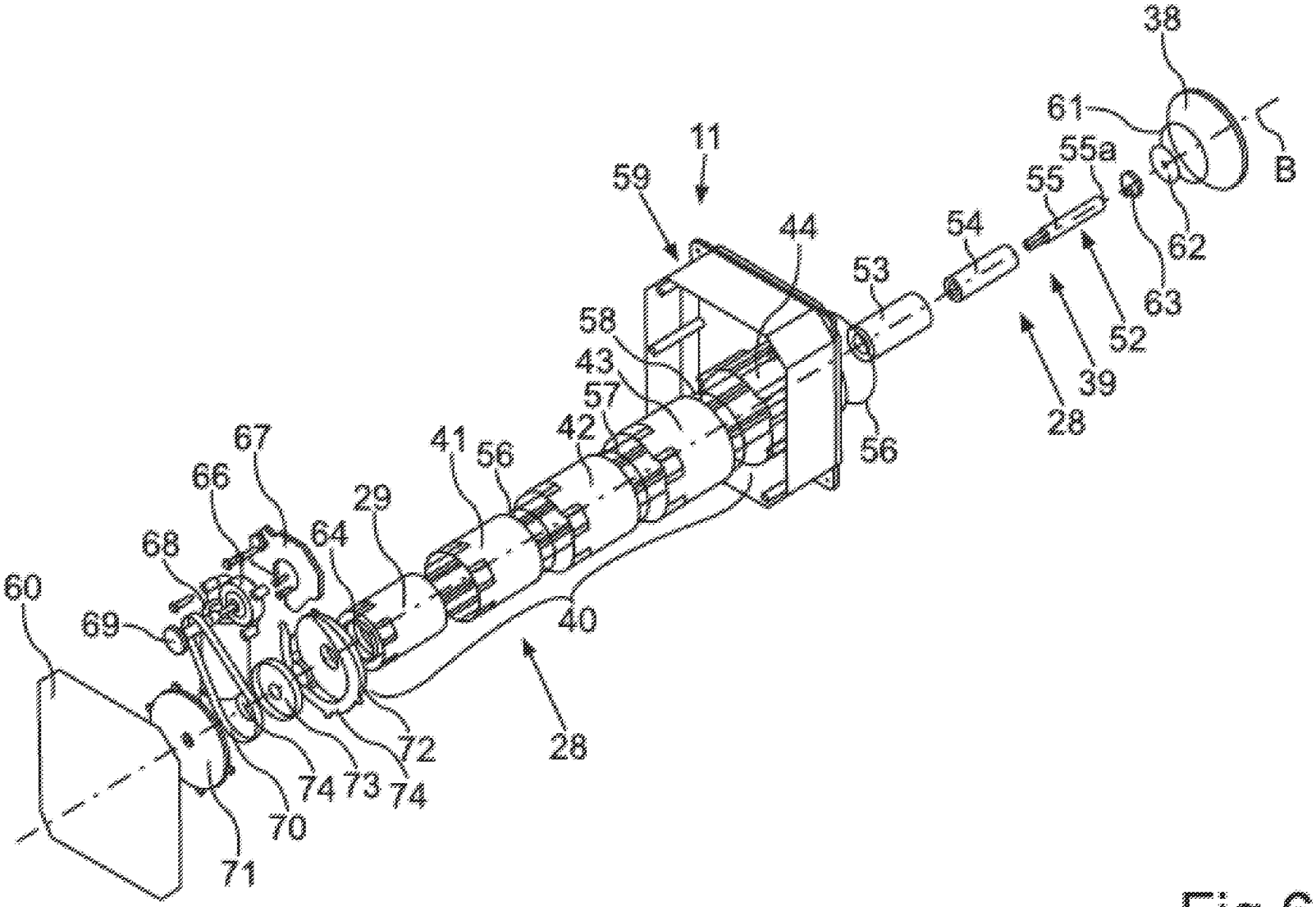
FIG. 6 shows an exploded view of an exemplary embodiment of a lifting device.

FIG. 6 shows an exemplary embodiment of a lifting device 11 in an exploded view.

Figure 7A:
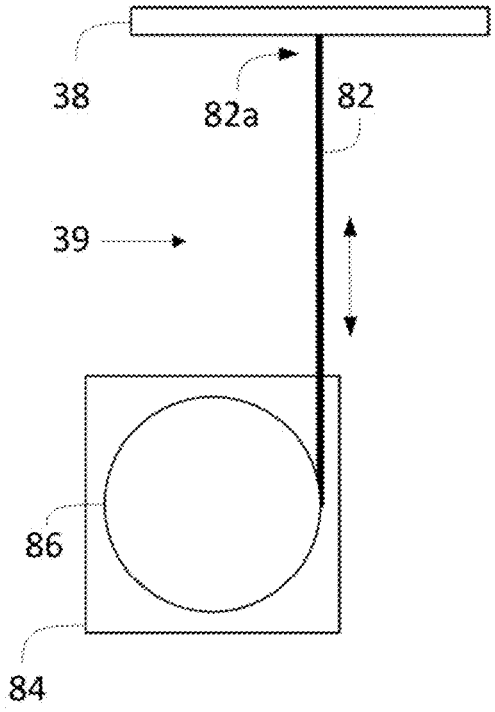
FIGS. 7A and 7B show schematic views of an exemplary embodiment of a lifting device.
Figure 7B:
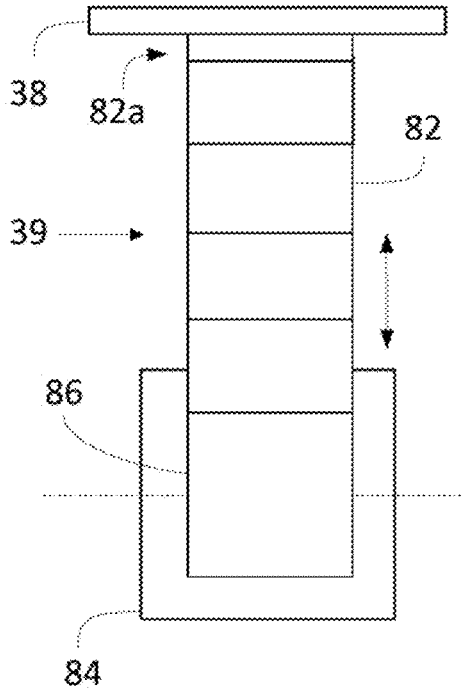

The lifting unit 28 is shown. This has a lifting mechanism 39. In the exemplary embodiment shown in FIG. 6 the lifting mechanism 39 is a spindle drive 52. In the exemplary embodiment the spindle drive 52 has at least two separate spindles. In particular, in the exemplary embodiment shown three spindles are provided, which are preferably made of plastic. These are a lower spindle 52, a central spindle 54 and an upper spindle 55. In the exemplary embodiment the upper spindle 55 is a trapezoid threaded spindle. The spindles 53 to 55 are rotatably connected to one another. The lifting device 11 has a longitudinal axis B. This is in particular parallel to the axis A. In the exemplary embodiment shown in FIGS. 7A and 7B, the lifting mechanism 39 can be a feed chain 82. The feed chain 82 can include specially shaped highly precise and mechanical chain links. The chain links engage over one another continuously in a form-fit manner. The special feature of the feed chain 82, in contrast to a "normal" chain, is that it works in both directions. It can pull and "push". Located in the drive housing 84 of the feed chain 82 is a pinion, which engages in the intermediate links of the chain 82 and moves the chain 82 link by link-both forward and backward (as shown by the double-ended arrows). The chain 82 itself has two loose ends. The load (e.g., cover or lift plate 38) to be moved is fastened to one end 82*a*. The other end can be guided freely and is generally rolled up (e.g., at 86) in a box (e.g., drive housing 84). This saves installation space and is the main advantage of the feed chain 82. Thrust power is exerted on the chain links via a drive element, generally an electric motor. The shoulders of the individual chain links are then pressed against one another and form a rigid unit. And thus, they can lift or push the load.

The lifting unit 28 additionally has a housing 40, as has already been explained for FIG. 5. The housing 40 has the housing segments 29, 41, 42, 43 and 44. These are sealed off from one another by sealing rings 56, 57 and 58. In addition, the lifting device 11 has a receiving housing 59. This receiving housing 59 is separate from the housing 40. The receiving housing 59 is embodied as box-like. The housing 40 is formed by the housing segments 29 and 41 to 44 shown, which are each hollow cylinders. The housing 40 is embodied as a telescopic housing. The receiving housing 59 has a base plate 60. As a result, the receiving housing 59 is closed from below. The base plate 60 is a separate plate. In the installed state the receiving housing 59 is arranged completely outside the receiving area 8. It is, as can be seen in FIG. 5, arranged completely underneath the base wall 3 of the basin 2. It is fastened to the base wall 3. The receiving housing 59 extends from a lower surface of the base wall 3 in a direction pointing away therefrom by less than 150 mm, in particular less than 100 mm downward.

As can be seen in FIG. 5, the housing segment 44 connected in the exemplary embodiment preferably integrally to the receiving housing 59 extends through the opening or through-hole 46.

Furthermore, FIG. 6 shows a seal 61 and two stoppers 62 and 63. The upper spindle 55 is in particular in direct contact with this stopper 63. A mechanical connection is thus formed to the plate 38, which represents a cover. It can be provided that this upper spindle 55 is connected to this plate 38 in a rotationally fixed manner. If the spindle drive 52 is moved in the direction of the longitudinal axis B, a change in length such as this in the direction of the longitudinal axis B can be brought about by a relative movement between the spindles 53 and 54. In particular, it can be provided in this example that the spindles 54 and 55 are infinitely rotatably connected to one another. This means that if the spindles 53 and 54 move apart from one another because of their thread couplings in the direction of the longitudinal axis B, the upper spindle 55 is pushed upward, but does not move apart from the spindle 54 in the height direction.

In an alternative embodiment it can be provided that the upper spindle 55 is likewise rotated about the longitudinal axis B in the event of a change in length of the spindle drive 52. In an embodiment such as this it is provided that this upper spindle 55 is connected by an infinite rotation unit to the plate 38 in an infinitely rotatable manner. This means that in the event of a rotation of the upper spindle 55 the plate 38 is not rotated at the same time, but remains in a fixed position in the direction about the longitudinal axis B. For example, an infinite rotation unit such as this can be formed by a ball bearing. Likewise, in the case of the aforementioned first exemplary embodiment, in which an infinite rotary movement facility between the spindle 55 and the spindle 54 is enabled, an infinite rotation unit providing coupling in this respect can be embodied, in particular likewise a ball bearing can be embodied.

In addition, the seal 75 already referred to in FIG. 5 is shown.

In addition, a detector 64 is represented in FIG. 6. This detector 64 is in particular a sensor, which detects liquid media in a volume space 65 (FIG. 5) between the sealing sleeve 47 and the lifting unit 28.

In addition, a motor 66 of the lifting device 11 is shown in FIG. 6. This motor 66 is arranged in the receiving housing 59. It is provided for driving the lifting mechanism 39 and thus in the exemplary embodiment the spindle drive 52. In particular, in this connection a motor flange 67, a tooth lock washer 68 and a drive shaft 69 are shown. The drive shaft 69 is in particular coupled to the spindle drive 52, in particular the lower spindle 53. In addition, in the exemplary embodiment a toothed belt 70 is also shown. Likewise, a bearing flange 71 is represented. A further bearing flange 72 is likewise represented. In addition, a further tooth lock washer 73 and a ball bearing 74, which in particular is a grooved ball bearing, are shown.

An attenuation unit is preferably also formed by the unit 51, as shown in FIG. 5. With this the lifting device 11 is acoustically decoupled from the base wall 3. This attenuation unit can be a rubber attenuator or also an acoustic foam. The attenuation unit is in particular arranged so as to rest directly on the lower surface of the base wall 3 and thus on the outer surface of the base wall 3. In particular, this attenuation unit is connected to the receiving housing 59 of the lifting device 11.

A disassembly mode different from the normal mode of the lifting unit 28 can also be set. In this, the lifting unit 28 is set over the maximum raised position of the lifting unit 28 in the normal mode and thus also over the corresponding position of the insert plate 10 to a position that lies even higher in the height direction. In the maximum raised position in the normal mode it is in particular provided that the upper surface 10*a* of the insert plate 10 is flush with the upper surface of the upper edge 2*a* of the basin 2 or with a decorative frame or an installation frame. In the disassembly position lying higher than this the insert plate 10 is preferably positioned such that its lower surface 10*b* is arranged higher by a vertical distance than this upper edge 2*a*. In particular, this vertical distance is at least 2 cm, in particular at least 3 cm. As a result, the insert plate 10 can be gripped at its edge 25 by a hand and held securely for removal from the lifting unit 28. The disassembly position is in particular a horizontal position of the insert plate 10. The lower surface 10*b* of the insert plate 10 is thus positioned completely above the upper edge 2*a*.

The invention claimed is:

1. A sink, comprising:

a basin including a base wall and lateral walls adjoining the base wall, said basin including a receiving area delimited by the base wall and the lateral walls;

an insert plate separate from the basin and inserted into the receiving area; and a lifting device configured to move the insert plate relative to the basin in a height direction, said lifting device including a lifting unit with a variable length, said lifting unit including a lifting mechanism embodied as a feed chain or a spindle drive, wherein the lifting device includes a receiving housing arranged under the base wall, and wherein the feed chain or the spindle drive is arranged in an interior of the receiving housing when the lifting device is in a retracted position.

2. The sink of claim 1, wherein the lifting unit includes a housing which circumferentially surrounds the lifting mechanism, said housing formed from multiple housing segments which are movable relative to one another in the height direction.

3. The sink of claim 2, wherein the housing segments are rigid.

4. The sink of claim 2, wherein the housing segments form a telescopic housing as the housing.

5. The sink of claim 1, wherein the lifting device includes a motor for driving the lifting mechanism, said motor being arranged in the receiving housing of the lifting device.

6. The sink of claim 1, wherein the base wall has an opening for passage of the lifting unit such that the lifting unit it is arranged on both sides of the opening.

7. The sink of claim 6, wherein the opening is provided in a central location of the base wall.

8. The sink of claim 1, wherein the lifting device includes a separate attenuation unit to acoustically decouple the lifting device from the base wall.

9. The sink of claim 8, wherein the attenuation unit is a rubber attenuator or an acoustic foam.

10. The sink of claim 8, wherein the attenuation unit rests directly on a lower surface of the base wall and is connected to the receiving housing of the lifting device.

11. The sink of claim 1, wherein the insert plate has an upper surface with a surface area which is at least 80% of a surface area of the receiving area in a horizontal plane, but is less than 99% of the surface area of the receiving area.

12. The sink of claim 1, wherein the insert plate has an upper surface with a surface area which is at least 90% of a surface area of the receiving area in a horizontal plane, but is less than 99% of the surface area of the receiving area.

13. The sink of claim 1, wherein the insert plate has an upper surface with a surface area which is at least 95% of a surface area of the receiving area in a horizontal plane, but is less than 99% of the surface area of the receiving area.

14. A sink, comprising:

a basin including a base wall and lateral walls adjoining the base wall, said basin including a receiving area delimited by the base wall and the lateral walls;

an insert plate separate from the basin and inserted into the receiving area; and a lifting device configured to move the insert plate relative to the basin in a height direction, said lifting device including a lifting unit with a variable length, said lifting unit including a lifting mechanism embodied as a feed chain or a spindle drive, wherein the spindle drive includes at least two separate spindles which are coupled to one another.

15. The sink of claim 14, wherein the at least two separate spindles are guided into one another.

16. The sink of claim 14, wherein the lifting device includes a cover, said insert plate being arranged on the cover, wherein an upper one of the at least two separate spindles has an upper end which is connected to the cover.

17. The sink of claim 16, wherein the cover is a cover plate.

18. The sink of claim 16, further comprising an infinite rotation unit, said upper one of the at least two separate spindles being connected in one of two ways, a first way in which the upper one of the at least two separate spindles is connected to the cover by the infinite rotation unit such that, when the lifting unit is raised in the height direction, the upper one of the at least two separate spindles is infinitely rotatable relative to the cover about an axis of rotation which is oriented in the height direction, a second way in which the upper one of the at least two separate spindles is connected to the cover in a rotationally fixed manner and the upper one of the at least two separate spindles is connected infinitely rotatably to another one of the at least two separate spindles of the spindle drive.

19. The sink of claim 18, wherein the infinite rotation unit is a ball bearing.

20. A sink, comprising:

a basin including a base wall and lateral walls adjoining the base wall, said basin including a receiving area delimited by the base wall and the lateral walls;

an insert plate separate from the basin and inserted into the receiving area; and a lifting device configured to move the insert plate relative to the basin in a height direction, said lifting device including a lifting unit with a variable length, said lifting unit including a lifting mechanism embodied as a feed chain or a spindle drive, wherein the lifting device incudes a receiving housing which is arranged underneath the base wall, said lifting device including a motor for driving the lifting mechanism, said motor being arranged in the receiving housing of the lifting device, and wherein the spindle drive includes at least two separate spindles which are coupled to one another, said motor being connected to a lower one of the at least two separate spindles such that the lower one of the at least two separate spindles is movable by the motor in a rotation about an axis of rotation oriented in the height direction.

* * * * *